United States Patent [19]

Benham

[11] 4,361,265

[45] Nov. 30, 1982

[54] REVERSE FOLD LOCK DISPLAY TRAY

[75] Inventor: Albert A. Benham, Granville, Mass.

[73] Assignee: Champion International Corporation, Stamford, Conn.

[21] Appl. No.: 276,786

[22] Filed: Jun. 24, 1981

[51] Int. Cl.[3] ..... B65D 1/40; B65D 5/44; B65D 5/22

[52] U.S. Cl. ..... 229/16 R; 229/34 HW; 229/8

[58] Field of Search ..... 229/16 R, 8, 34 HW

[56] References Cited

U.S. PATENT DOCUMENTS

| | | | |
|---|---|---|---|
| 2,061,992 | 11/1936 | Wilson | 229/8 |
| 2,132,957 | 10/1938 | Mahone | 229/16 R |
| 2,287,648 | 6/1942 | Sunderhauf | 229/16 R |
| 2,844,473 | 7/1958 | Seiferth | 229/8 |
| 2,912,154 | 11/1959 | Doran | 229/34 HW |
| 3,905,543 | 9/1975 | Randles | 229/34 HW |
| 4,003,514 | 1/1977 | Graser | 229/34 HW |

*Primary Examiner*—Herbert F. Ross

*Attorney, Agent, or Firm*—Evelyn M. Sommer

[57] ABSTRACT

A display tray is provided with opposed double side walls formed by cutting panels from a top wall of the tray and pivoting the panels downwardly so that a portion of each panel is adhesively secured to the bottom wall of the tray. The double side wall construction furnishes an air space on opposed sides of a product held within the tray to cushion movement thereof and the opening formed in the top wall enables visibility of the product positioned within the tray. End closure panels are connected to the bottom and top panels, respectively, for closing opposed ends of the tray. The end closure panels connected to the bottom panel include slots for receiving a corresponding tab extending outwardly from each of the closure panels connected to opposed end edges of the top panel, which are folded 180° about the bottom closure panel so that the tabs may be inserted into the slots to form an end panel lock. The tray may be inserted in an outer, sleeve having a window to protect the product while maintaining the product in open view for inspection.

6 Claims, 10 Drawing Figures

Fig. 1.
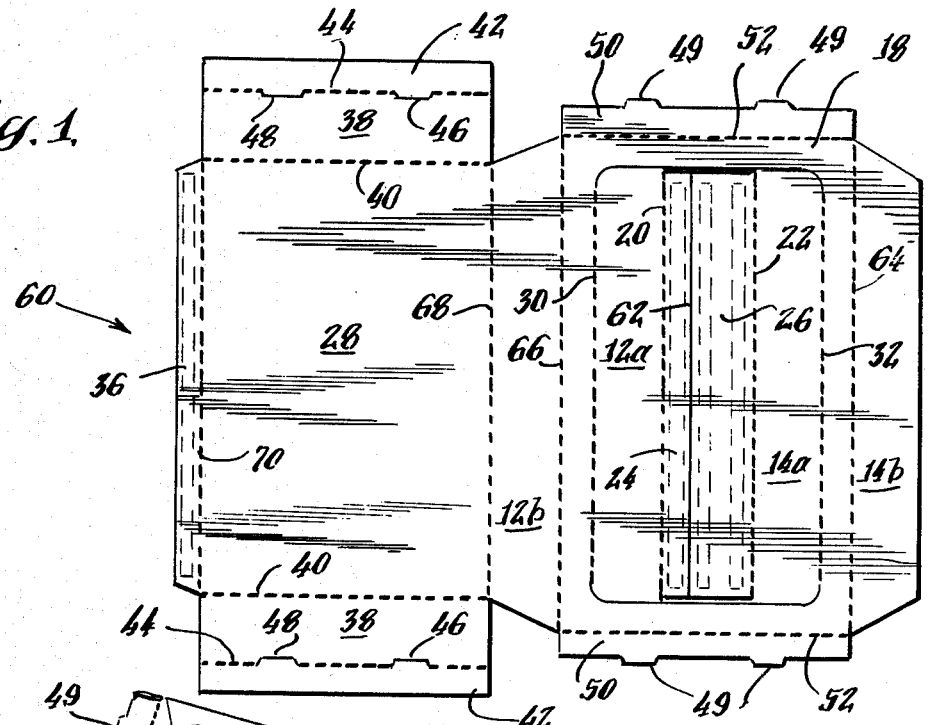
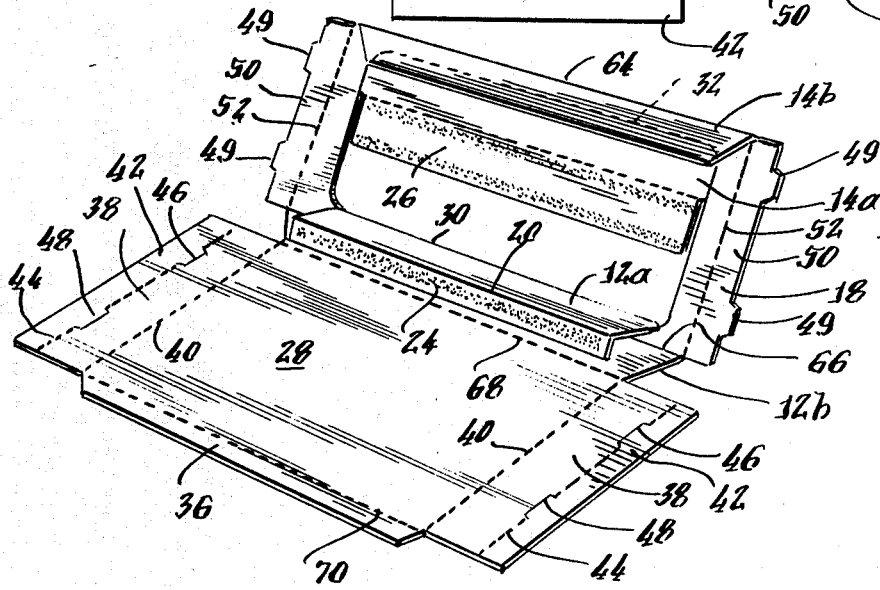
Fig. 2.
Fig. 3.
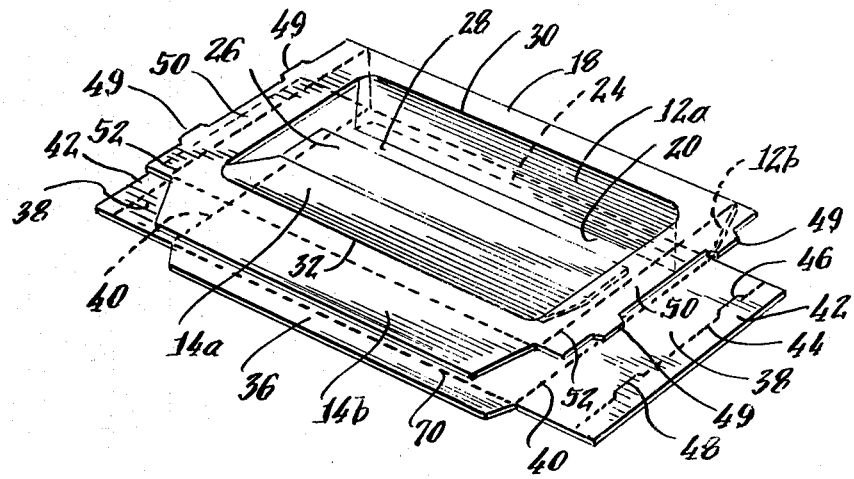

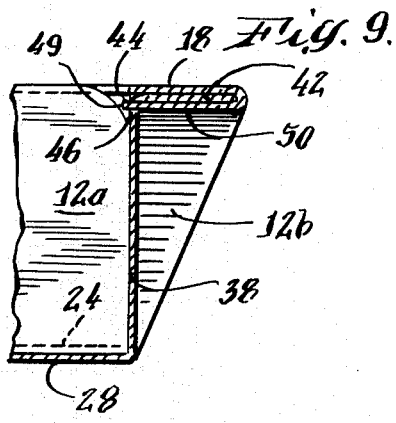
Fig. 9.
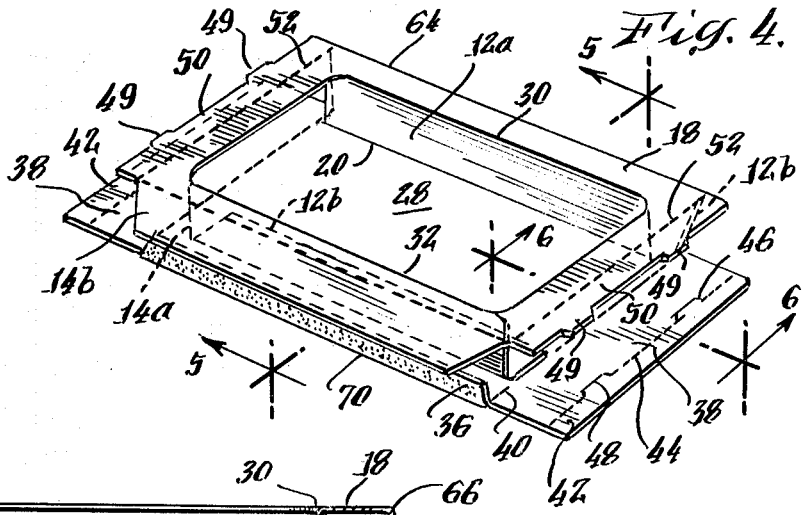
Fig. 4.
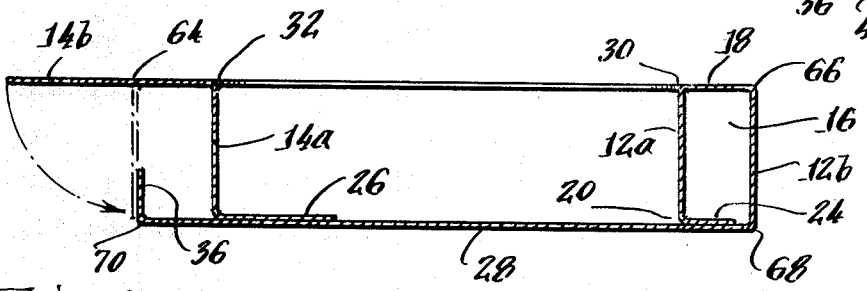
Fig. 5.
Fig. 6.
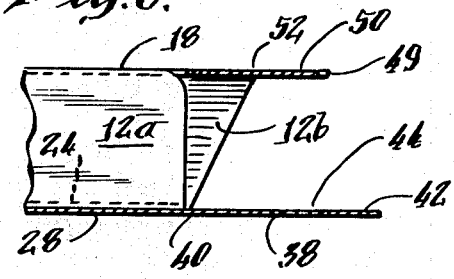
Fig. 7.
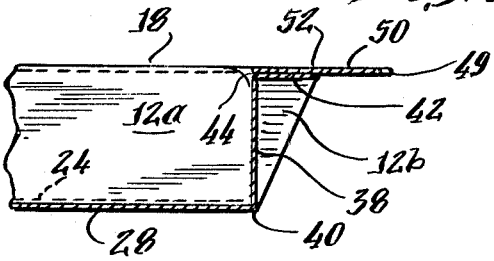
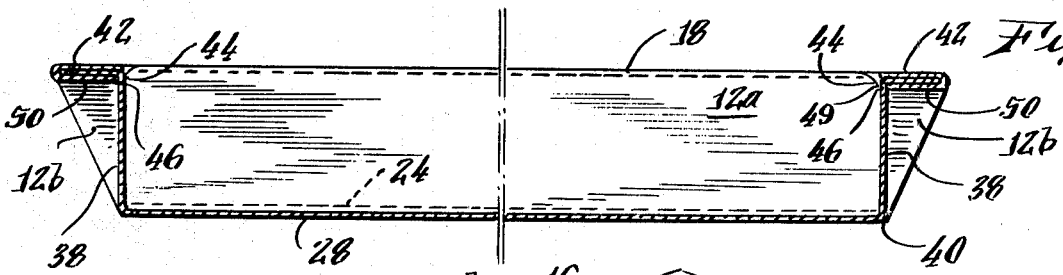
Fig. 8.
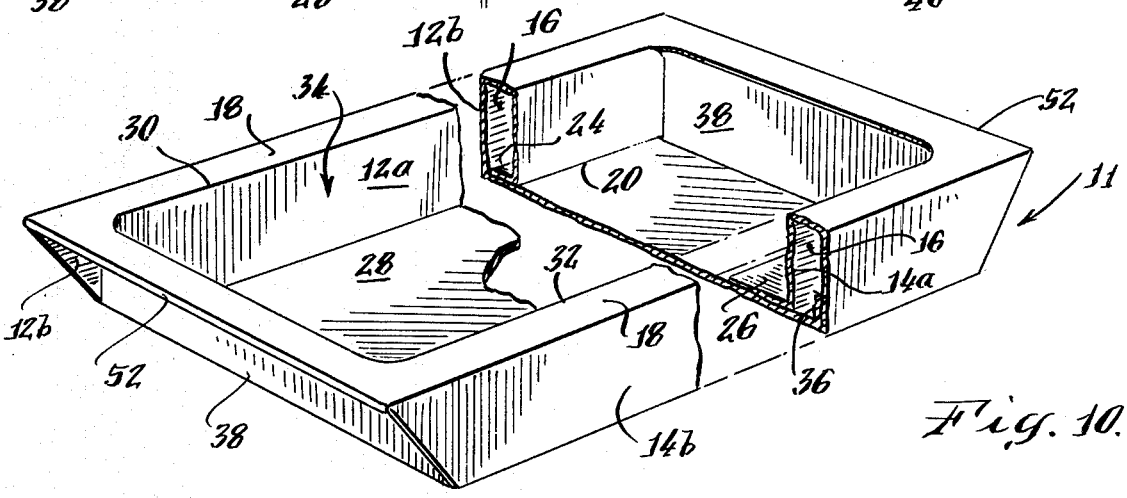
Fig. 10.

REVERSE FOLD LOCK DISPLAY TRAY

BACKGROUND AND SUMMARY OF THE INVENTION

This invention relates to a paperboard display tray having easy opening and self-locking end panels.

The tray of the present invention is formed from a single paperboard blank and is economical and easy to assemble so as to provide an open-top tray to display one or more products to full view, while providing double-spaced sidewalls with an air space therebetween to cushion and preclude jostling of the product within the display space in the tray. Further, the tray of the present invention is provided with an easily accessible interior for loading and removing a product as the end walls are formed from panels which include interengaging slots and tabs to form snap locks for opening and closing the same. The assembled tray may be placed in a conventional outer sleeve with a full window displaying the product loaded within the interior of the open-topped tray of the present invention.

The tray is formed by cutting panels from a top wall of the tray and pivoting the panels downwardly so that a portion of each panel is adhesively secured to spaced portions of a bottom wall of the tray. The double side wall construction formed from the panels cut from the top wall furnishes an air space on opposed sides of a product positioned within the tray to cushion movement thereof and the opening formed in the top wall enables visibility of the product positioned within the tray to be maintained.

End closure panels are connected to the bottom and top panels, respectively, for closing opposed ends of the tray. The end closure panels connected to the bottom panel includes slots for receiving a corresponding tab extending outwardly from each of the closure panels connected to opposed end edges of the top panel, which are folded 180° about the bottom closure panel, so that the tabs may be inserted into the slots to form an end panel lock.

BRIEF DESCRIPTION OF THE DRAWINGS

Further objects and advantages of the invention will become apparent from the following description and claims, and from the accompanying drawings, wherein:

FIG. 1 is a plan view of a blank for forming the tray of the present invention;

FIGS. 2 to 4 inclusive are perspective views illustrating intermediate steps in the folding of the blank of FIG. 1 to form the tray of the present invention;

FIG. 5 is a cross-sectional view taken substantially along the plane indicated by line 5—5 of FIG. 4;

FIG. 6 is a cross-sectional view taken substantially along the plane indicated by line 6—6 of FIG. 4;

FIGS. 7 and 8 are views similar to FIG. 6, but illustrating the completion of a reverse fold lock for the corner panels of the tray of the present invention;

FIG. 9 is an enlarged cross-sectional view of the right-hand portion of FIG. 8 illustrating the reverse fold lock; and FIG. 10 is a perspective view, partly broken away and partly in section of the tray of the present invention.

DETAILED DESCRIPTION OF THE PREFERRED EMBODIMENT

Referring now to the drawings in detail, wherein like numerals indicate like elements throughout the several views, the tray 11 of the present invention includes a pair of spaced, inner and outer sidewalls 12*a*, 12*b* and 14*a*, 14*b* respectively.

Each pair of sidewalls is separated by an airspace 16. Sidewalls 12*a* and 14*a* are formed by cutting rectangular panels from the top wall 18 of the tray 11 and scoring the panels along lines 20 and 22, respectively (see FIG. 1). The portion of each of the panels 12*a*, 14*a* below each score line 20, 22, respectively, forms a glue panel 24 and 26, respectively, which is adhesively secured to the interior of a bottom panel 28 spaced from the side edges thereof. By folding panels 12*a*, 14*a* into the interior of tray 11 about score lines 30 and 32, respectively, connecting each of the panels to the top panel 18 of the tray 11, a display window 34 is provided for displaying one or more products positioned within the interior of the tray between inner sidewall panels 12*a*, 14*a*. Further, the double sidesall panels 12*a*, 12*b* and 14*a*, 14*b*, separated by airspace 16 between each panel pair, cushions the product within the interior of the display tray 11 and generally will preclude movement thereof.

The tray 11 is generally rectangular in plan and forms a solid rectangular parallelopiped. In order to complete the three dimensional shape of the tray, a glue flap 36 secured to one of the side edges of the bottom panel 28 is adhered to the inner surfaces of outer sidewall 14*b*.

Access to the interior of tray 11 may be had through either end wall of the tray.

The end walls of the tray are formed by an end closure panel 38 foldably connected along the score line 40 to each end of the bottom panel 28. Panel 38 has a second closure panel portion 42 foldably connected to main panel 38 along a scoreline 44. Spaced slits 46 and 48 are formed at spaced locations along the score line 44 so that when panel 42 is bent or pivoted relative to panel 38, a slot is formed for receiving a tab on a second end closure panel 50 pivotally connected by a score line 52 to the opposed, end edges of the top panel 18.

As illustrated in FIG. 1, the tray 11 is formed from a unitary one-piece, paperboard blank 60. The top panel 18 includes the scored and severed second side panels 12*a*, 14*a* hingedly connected to interior score lines 30, 32 and severed along a line 62. Substantially rectangular closure panels 50 extend from opposite ends of top panel 18 and each include a pair of spaced tabs 49. Outer sidewall panels 12*b*, 14*b* extend outwardly from opposed side edges 64 and 66, respectively, of top panel 18.

Bottom panel 28 is substantially rectangular in shape having the same width as top panel 18, but is shorter in length. Bottom panel 28 is connected to the opposed free edge of outer side panel 12*b* along a score line 68. The opposite side edge of panel 28 is pivotally connected along scoreline 70 to glue flap 36. The opposed end edges of bottom panel 28 are connected by score lines 40 to the first end closure panel 38, each of which is also substantially rectangular in shape. Each of the first end closure panels 38 are connected to a second closure panel 42 by scoreline 44. Slits 46 and 48 are cut along each of the scorelines 44, to form a female portion of a snaplock arrangement; the male portion being provided by the tabs 49 on the top closure panels 50 connected to each of the end edges 52 of the top panel 18.

FIGS. 2 to 8 illustrate the folding and assembly of blank 60 into tray 11.

First, the panels 12*a* and 14*a* are pushed downwardly out of the plane of top panel 18 and the top panel 18 is folded into parallel relation with the bottom panel 28 about side scorelines 66, 68 and 64. Glue flap 36 is folded about scoreline 70 and adhesively secured to the inner surface of outer sidewall panel 14*b*. Then, the inner sidewall panels 12*a*, 14*a* are folded about the respective internal scorelines 20 and 22, respectively, to form glue flaps 24 and 26 which are adhesively secured to the bottom panel 28 to space the top panel 18 from the bottom panel 28 and form the display window 34.

Each of the end closure flaps 38 may then be pivoted about its scoreline 40 connected to bottom panel 28 into a substantially upright condition, as illustrated in FIGS. 7 and 8. The height of each of the end closure flaps 38 when perpendicular to bottom panel 28 is substantially equal to the height of each of the sidewall panels 12*b*, 14*b*. Second closure flap 42 pivotally connected by scoreline 44 to first closure flap 38 is then disposed in a substantially horizontal relation extending outwardly or forwardly from the first bottom end wall panel 38 substantially parallel to the bottom panel 28 and beneath the framing portion of the top wall panel 18 forming a flange about the display window 34. Each of the top closure flaps 50 may then be bent 180° about its scoreline 52 (FIG. 8) pivotally connecting it to top panel 18 and panel 42, and each of the lock tabs 49 inserted within a corresponding one of the slots 46, 48 formed along scoreline 44 between first closure panel 38 and second closure panel 42 to lock the top closure panel to the bottom closure panel at each end of tray 11.

With a product inserted through either end of tray 11 and the top and bottom closure panels securely locked together by tabs 49 and slots 46, 48, the product may be displayed in framed window opening 34. The assembled tray 11 may then be placed in a conventional outer carton or sleeve having a window displaying the enclosed product, if desired.

What is claimed as new is:

1. A display tray comprising:

a top panel having an opening formed therein, a bottom panel of shorter length than said top panel and spaced from and parallel to said top panel, a side panel extending between outer parallel side edges of the top and bottom panels, a second side panel pivotally connected to the side edges defined said opening formed in said top panel and connected to said bottom panel, each of said second side panels being spaced from and parallel to adjacent first side panels, an end closure panel between substantially parallel end edges of said top and bottom panels, each of said end closures including a first end closure panel hingedly connected to said top panel, a second end closure panel hingedly connected to said bottom panel, said first end closure panel is in underlying relationship and substantially parallel to said top panel, and said end closure panel includes a first portion substantially perpendicular to said bottom panel and a second portion parallel to said top panel between said first end closure panel and said top panel, and means for releasably locking said first and second end closure panels together.

2. A display tray in accordance with claim 1 wherein said locking means includes at least one tab on one of said end closure panels and a corresponding slot in the other one of said end closure panels receiving said tab.

3. A tray in accordance with claim 2 wherein said tabs are on said first end closure panel and said slots are formed along a scoreline connecting the first portion of said second end closure panel to said second portion of said second end closure panel.

4. A blank for forming a display tray comprising:

a substantially first rectangular panel including a pair of interior hinged panels cut therein for forming a rectangular opening therein, each of said interior panels abutting along a free edge and a parallel edge hinged along spaced, parallel lines within the interior of said first rectangular panel, a second substantially rectangular panel spaced from said first rectangular panel and is substantially of the same width as said first rectangular panel but of a shorter length thereof, a truncated third panel connecting said first and second rectangular panels, and end closure panels hingedly connected to opposed ends of said first and second rectangular panels, respectively, the closure panels hingedly connected to said first rectangular panel including tabs extending outwardly therefrom, and the closure panels extending from said second rectangular panel including first and second portions connected by a scoreline therebetween, and at least one slot formed along the scoreline between the first and second portions of said closure panels hingedly connected to said second rectangular panel.

5. A blank in accordance with claim 4 including a fourth panel hingedly connected to a side edge of said first rectangular panel, and a glue flap hingedly connected to a side edge of said second rectangular panel.

6. A blank in accordance with claim 4 wherein each of said interior panels includes a scoreline intermediate its abutting free edge and edge hingedly connected within the interior of said first rectangular panel.

* * * * *